United States Patent [19]

Leskovec

[11] 4,219,302

[45] Aug. 26, 1980

[54] CYLINDER ARRANGEMENT FOR RAISING A CARRIAGE AND UPRIGHTS OF A MAST

[75] Inventor: Edward V. Leskovec, Eastlake, Ohio

[73] Assignee: Towmotor Corporation, Mentor, Ohio

[21] Appl. No.: 877,052

[22] Filed: Feb. 13, 1978

[51] Int. Cl.[2] ..... B66B 9/20

[52] U.S. Cl. ..... 414/635; 187/9 E

[58] Field of Search ..... 214/674; 187/9 R, 9 E; 414/635

[56] References Cited

U.S. PATENT DOCUMENTS

| | | | |
|---|---|---|---|
| 2,399,632 | 5/1946 | Guerin | 187/9 E |
| 2,581,791 | 1/1952 | Gilman | 187/9 E |
| 2,627,943 | 2/1953 | Hastings | 187/9 E |
| 3,127,956 | 4/1964 | Hosbein | 187/9 E |
| 3,394,778 | 7/1968 | Brinton | 187/9 E |

FOREIGN PATENT DOCUMENTS

| | | | |
|---|---|---|---|
| 1396715 | 6/1975 | United Kingdom | 187/9 E |

*Primary Examiner*—Robert G. Sheridan

*Attorney, Agent, or Firm*—Phillips, Moore, Weissenberger, Lempio & Majestic

[57] ABSTRACT

A lift truck having a mast assembly for lifting a load. The assembly includes a first fixed pair of spaced-apart uprights and a second movable pair of spaced-apart uprights with the second pair nested for vertical translation within the first pair, and a carriage coupled to the second pair for vertical translation in relation to the second pair. Two chains, which extend over two sheaves connected to a cross-member fixed to the upper ends of the second pair of uprights, have one end connected to a first hydraulic cylinder and their other end to the carriage. Second and third hydraulic cylinders, behind the first and second pair, are coupled to respective third and fourth sheaves about which extend additional chains having one end connected to the fixed uprights and the other end connected to the movable uprights. The first hydraulic cylinder lifts the carriage in relation to all the uprights and the second and third hydraulic cylinders simultaneously raise the second pair of uprights and the carriage. The second and third hydraulic cylinders are anchored on a cross-brace intermediate the ends of the uprights and acted on by a fourth hydraulic cylinder to tilt the assembly.

14 Claims, 4 Drawing Figures

CYLINDER ARRANGEMENT FOR RAISING A CARRIAGE AND UPRIGHTS OF A MAST

BACKGROUND OF THE INVENTION

This invention relates to a lift assembly for a lift truck and, more particularly, to a hydraulic cylinder arrangement for lifting uprights of a mast and a load-carrying carriage supported by the uprights.

Conventional lift trucks have on their front end a mast or lift assembly including telescoping uprights and a fork lift carriage supported by the uprights. The uprights, when extended, permit high lifting of a load while allowing the truck to have relatively low overall height when the extended uprights are lowered.

In addition, in one type of lift truck, the load carriage is movable vertically without extension of the uprights. A carriage which has this kind of movement is said to have "free lift", which is desirable since it allows a load to be lifted without extension of the uprights. The carriage engages the load in a lower position and thereafter can be raised to a desired elevation without extension of the uprights. In this raised position the load may be transported to another location, and the carriage then lowered and unloaded. Thus, with a "free lift" type of carriage, the load can be lifted without increasing the overall height of the assembly, thereby permitting operation in areas of low overhead.

The uprights and carriage usually are lowered and raised by hydraulic cylinder assemblies which are strategically positioned on the truck. In considering this positioning, one goal is to utilize hydraulic cylinder assemblies and their connections to the uprights and carriage which are simple in design. Another object is to use components for the cylinder assemblies which are as small as possible so that the weight of the lift assembly is kept to a minimum.

Furthermore, it is also important to design a load-lifting assembly which will give the driver of the truck maximum visibility in the forward direction. Consequently, it is desirable to position the hydraulic cylinder assemblies and their connections to the uprights and carriage in such a manner as to minimize their interference with the driver's line of sight.

While there are many types of lift assemblies for lift trucks, one problem is that they sacrifice one or more advantageous features to obtain another. Thus, for example, in one assembly where free lift is provided, a cylinder rod has to be raised into the line of sight of the driver to raise the carriage, thereby impairing visibility. Or, in other assemblies, hydraulic cylinders for extending the uprights are positioned directly behind the uprights to improve visibility; however, these cylinders typically are relatively long, extending almost the entire length of the mast. Consequently the mast must be located further from the truck to allow room for positioning of the long cylinders, but this positioning must be done at the sacrifice of producing additional, undesirable load moments.

SUMMARY OF THE INVENTION

The present invention is directed to overcoming one or more of the problem as set forth above.

According to the present invention, there is provided a load-lifting assembly, comprising a first pair of fixed, elongated, spaced-apart uprights; a second pair of movable, elongated, spaced-apart uprights nested within said first pair of uprights; a carriage means for carrying a load and movable in relation to said second pair; first means, connected between and to said second pair, for moving said carriage means in relation to and without movement of said second pair, including a first lifting means, a cross-member above said lifting means and connecting said second pair, first sheave means connected to said cross-member, and first chain means movable over said first sheave means and connected at one end to said lifting means and at the other end to said carriage means, said lifting means moving said chain means to lift said carriage means; and second means for moving said second pair relative to said first pair.

DETAILED DESCRIPTION OF THE DRAWINGS

Figure 1:
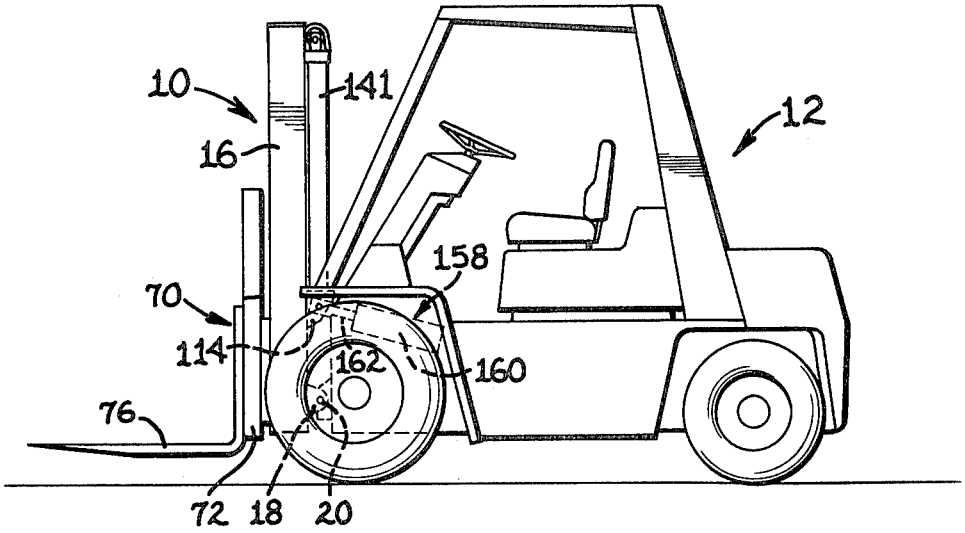
FIG. 1 is a perspective view of a lift truck incorporating the present invention.
Figure 2:
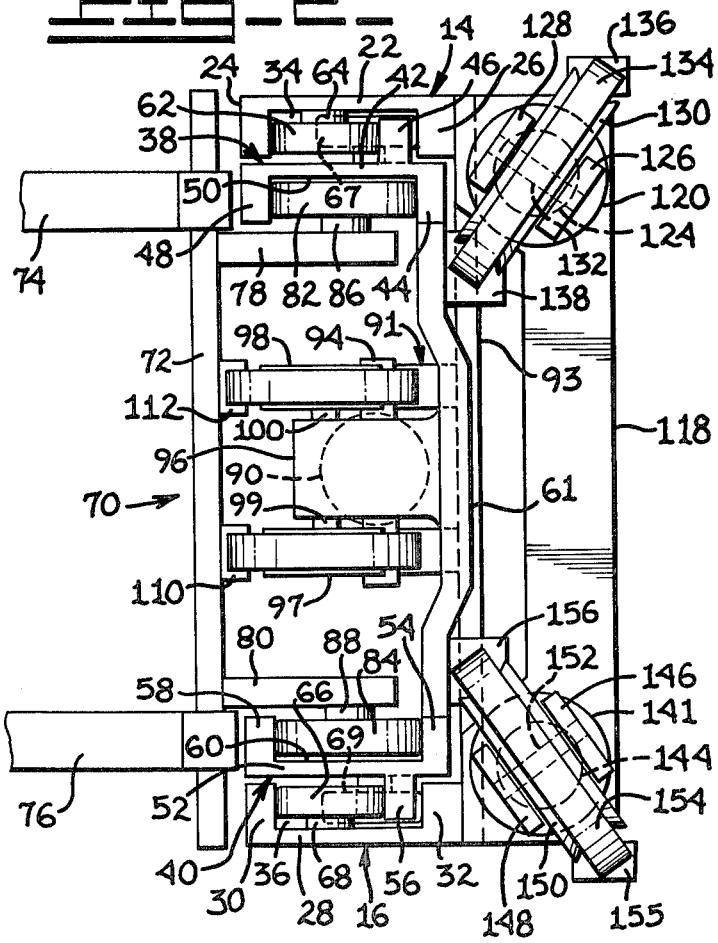
FIG. 2 is a plan view of the mast, cylinder and carriage assembly of FIG. 1.
Figure 3:
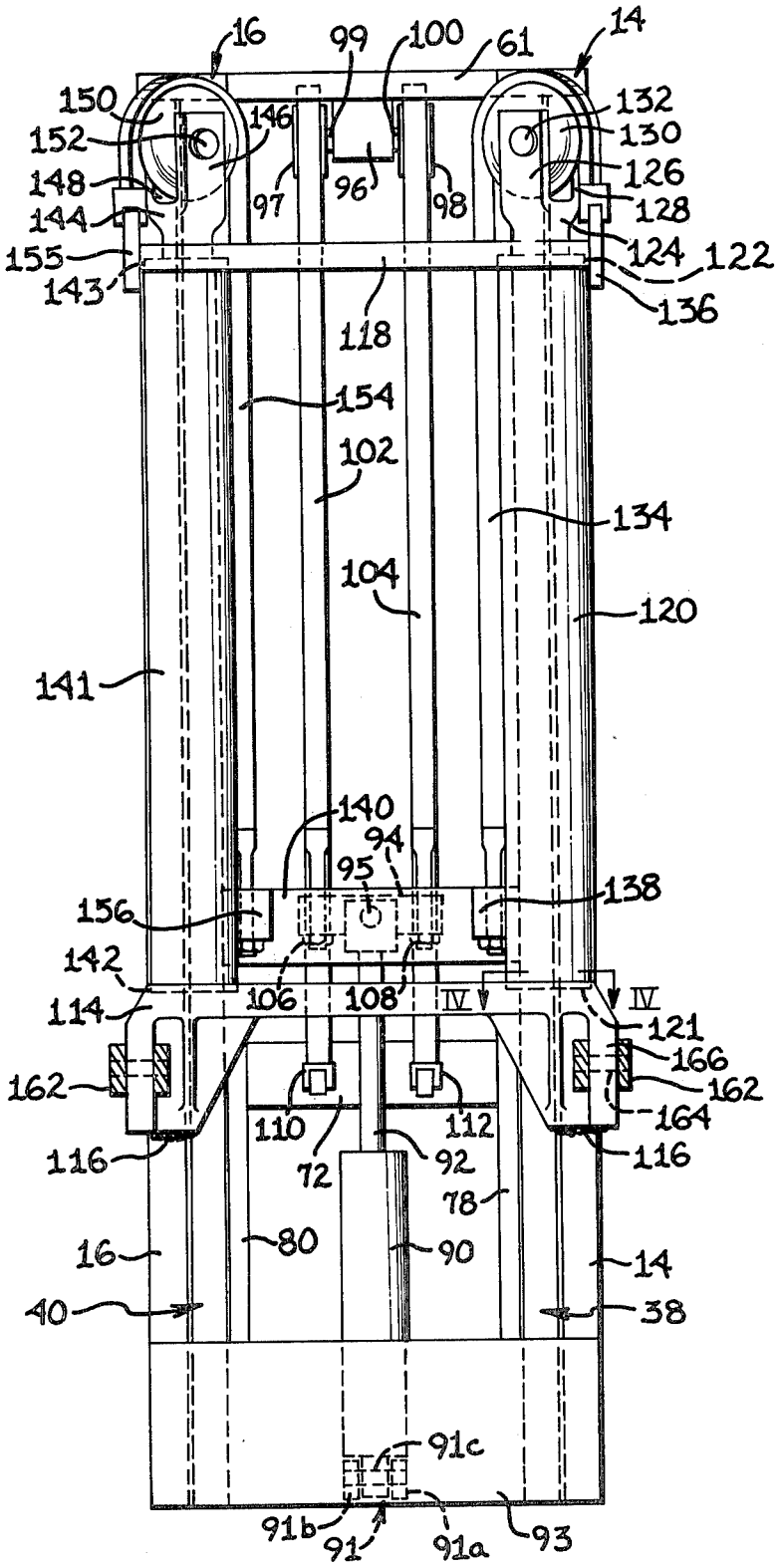
FIG. 3 is a rear elevation of the assembly of FIG. 2 with the mast not extended and the carriage in its lowered position.

Shown generally in FIG. 1 is a mast 10 in association with a truck 12. With reference to FIGS. 2 and 3, the mast 10 includes a first pair of longitudinal, laterally spaced uprights 14, 16 which are fixed in a vertical direction in relation to the body of the truck 12. However, as indicated in FIG. 1, the uprights 14, 16 are each pivotally connected to the body of the truck 12 at their lower ends by a bracket 18 and pivot 20 to tilt the mast 10 as will be described, there being shown only one bracket 18 and pivot 20.

The upright 14 is U-shaped and includes a base 22 and forward and rearward parallel flanges 24, 26, respectively, these flanges being generally perpendicular to base 22. Similarly, upright 16 is U-shaped and includes a base 28 with forward and rearward flanges 30, 32, respectively, these flanges also being generally perpendicular to base 28. As will be seen, the flanges 24, 26 extend from base 22 towards upright 16, while the flanges 30, 32 extend from base 28 towards upright 14. These uprights 14, 16 define a respective channel 34, 36.

The lift mast 10 also includes a second pair of longitudinal, laterally spaced uprights 38, 40 which are extendible in the vertical direction in relation to the uprights 14, 16. Upright 38 includes a base 42, having at its rearward end two flanges 44, 46, and at its forward end a single flange 48. These three flanges 44, 46, 48 extend generally perpendicular to base 42, with flange 46 extending into the channel 34. Upright 38 defines another channel 50 between flanges 44 and 48.

The upright 40 similarly includes a base 52 having at its rear end two flanges 54, 56 and at its forward end flange 58. These three flanges 54, 56, 58 also extend generally perpendicular to base 52, with flange 56 extending into channel 36. Upright 40 defines a channel 60 between flanges 54 and 58. As will be seen, flanges 44 and 48 extend toward upright 40 while flanges 54, 58 extend toward upright 38. A cross-member 61 is fixed to flanges 44 and 54 near the top of these flanges to couple uprights 38 and 40 together.

A roller 62 is mounted near the top of upright 14 to the base 22 by a support 64. Roller 62 is within channel 34 and in rolling contact the flange 46. Another roller 66 is mounted to the base 28 by a support 68 near the top of upright 16. Roller 66 is positioned within channel 36 and is in rolling contact with flange 56. Additional rollers 67 and 69 (shown in dotted lines in FIG. 2) are similarly connected, respectively, near the bottom of uprights 38 and 40 to bases 42 and 52. The two rollers 67 and 69 ride within channels 34 and 36, and are in rolling contact with flanges 26 and 32, respectively. In this manner, uprights 38 and 40, which are substantially of the same length as uprights 14 and 16, can be moved via the rollers to extend the former uprights upwards in relation to the latter.

As shown in FIGS. 1 and 2, associated with the uprights 14, 16, 38 and 40 is a load-lifting fork type carriage 70. A frame 72 of the carriage 70 has extending forwardly therefrom two forks 74, 76 which can be moved under a load to support the load as the truck 12 is moved to a new location. The frame 72 also has extending rearwardly therefrom two flanges 78, 80, each supporting a respective top roller 82, 84, through respective supports 86, 88. Roller 82 is positioned within channel 50 and in rolling contact with flange 48 and roller 84 is positioned within channel 60 and in rolling contact with flange 58. Though not shown, flanges 78 and 80 also support, respectively, a bottom roller beneath respective rollers 82 and 84, in which these bottom rollers are in rolling contact with flanges 44 and 54, respectively. In this manner, the carriage 70 can be moved vertically in relation to the uprights 38 and 40, as well as uprights 14 and 16.

As shown in FIGS. 2 and 3, a cylinder 90 is connected at its lower end to a support shown generally at 91, and has a cylinder or piston rod 92 which is fully extendible from the cylinder 90 to its position shown in FIG. 3. Support 91 includes a pair of projections 91*a* and 91*b* which extend outwardly from a cross branch 93, and a pin 91*c* which extends through projections 91*a* and 91*b* and the base of cylinder 90. Cross brace 93 ties fixed uprights 14 and 16 together at their base.

A horizontal bar 94 is pivotally connected to the upper end of cylinder rod 92 by a pivot 95. A flange 96 extends from the bottom of upper cross-brace 61 and rotatably supports two sheaves 97 and 98 via axles 99 and 100, respectively. Two chains 102, 104 extend over respective sheaves 97, 98 and are connected at their one ends by clamps 106, 108 to opposite sides of the bar 94, and at their other ends to clamps 110, 112 connected to frame 72 of carriage 70. As will be more fully described, retraction of rod 92 into cylinder 90 will cause chains 102, 104 to move around sheaves 97, 98 to lift carriage 70 along with any load being carried. The bar 94 will be allowed to move about pivot 95 to equalize the load on the chains 102, 104, depending on the position of the load on the forks 74, 76 of carriage 70.

Figure 4:
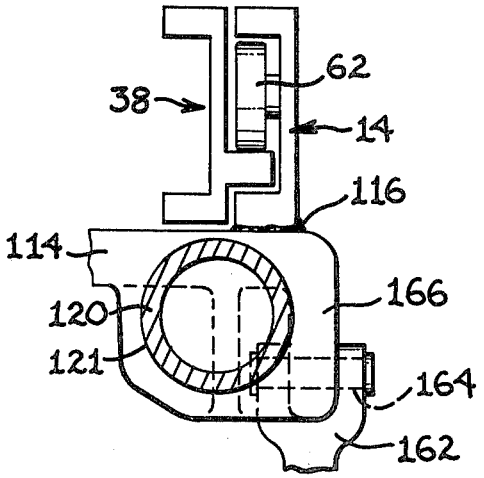
FIG. 4 is a section taken through lines 4—4 of FIG. 3.

As shown in FIGS. 3 and 4, a cross-brace 114 is welded at 116 to the rearward sides of flanges 26, 32 to couple uprights 14, 16 together and maintain them in their spaced-apart relationship. As indicated in FIG. 3, cross-brace 114 is connected approximately a third of the distance up from the lower ends of uprights 14, 16. Similarly, as shown in FIGS. 2 and 3, an upper cross-brace 118 is welded to the rearward sides of flanges 26, 32 to couple the upper portions of uprights 14 and 16 together.

A cylinder 120 is anchored at its lower end within a bore 121 of the cross-brace 114, and at its upper end extends within an aperture 122 of cross-brace 118. Cylinder 120 is behind uprights 14 and 38 and has a cylinder or piston rod 124 extendible from the cylinder 120, the rod 124 having a forked upper end comprising teeth 126, 128 rotatably supporting a sheave 130 via an axle 132. A chain 134 extends over the sheave 130 and is fixed at one end to the cross-brace 118 by a suitable clamp 136. The other end of chain 134 is connected via a clamp 138 to a cross-member 140 which is fixedly connected to the lower ends of uprights 38 and 40 as indicated in FIG. 3.

Another cylinder 141 is anchored at its lower end within another bore 142 of the cross-brace 114, and at its upper end extends within an aperture 143 of cross-brace 118. Cylinder 141 is behind uprights 16, 40 and has a cylinder or piston rod 144 extendible from cylinder 141, the rod 144 having a forked upper end including teeth 146, 148 rotatably supporting a sheave 150 via an axle 152. A chain 154 extends over sheave 150 and has one end connected to the cross-brace 118 by a suitable clamp 155. The other end of chain 154 is coupled to the cross-member 140 via a clamp 156. As shown in FIG. 2, sheaves 130, 150 are angularly located in relation to the longitudinal axes of the uprights 14, 16, 38, 40.

As shown in FIG. 1, there is provided a tilting mechanism 158 for pivoting the assembly 10 about the pivot 18. This mechanism 158 includes a pair of cylinders 160 and cylinder or piston rods 162 extendible from the cylinders 160, there being shown only one cylinder 160 and rod 162. Each rod 162, as shown in FIGS. 3 and 4, has an outer forked end connected to the cross-brace 114 with a pin 164 extending through the forked end and a flange 166 of the brace 114.

The several cylinder and rod arrangements 90, 92 and 120, 124 and 141, 144 and 160, 162 are hydraulic assemblies. As is well known, hydraulic fluid can be caused to flow in and out of the cylinders 90, 120, 141 and 160 to extend or retract the respective rods 92, 124, 144 and 162. Furthermore, while a hydraulic circuit including pressure lines, control valves and a fluid reservoir is not illustrated, such circuit could be easily made by one skilled in the art in accordance with well-known techniques to operate the invention as will now be described.

As already indicated, and as shown in FIG. 3, rod 92 is in it fully extended position whereby the carriage 70 is in the lowered position shown in FIG. 1. If it is desired to "free lift" the carriage 70, hydraulic fluid is introduced into cylinder 90 to cause rod 92 to retract into the cylinder. As rod 92 retracts, the ends of chains 102, 104 connected to bar 94 are lowered while the ends connected to cross-member 72 are raised. The chains 102, 104 thereby move about sheaves 97, 98 and the carriage 70 is moved upwardly. As is well known, the carriage 70 can move, for example, at a 1:1 ratio relative to the movement of rod 92. The full distance that rod 92 may be extended is, for example, seven inches, so that withdrawing the rod 92 into the cylinder 90 by this amount will raise the carriage about seven inches from its lowest position. Retraction of the rod 92 the maximum distance, i.e., seven inches in the example, will position the frame 72 a short distance upwards along the length of the uprights 14, 16.

Then, if it is desired to extend the uprights 38, 40, hydraulic fluid is introduced into cylinders 120, 141 to raise rods 124, 144. As these rods are being elevated, chains 134, 154 will move about sheaves 130, 150 and thereby raise cross-member 140, so that uprights 38 and 40 will be extended. As this is occurring, cross-member 61 also is being raised so that once again chains 102, 104 will move about sheaves 97, 98. As a result of this action, frame 72 will rise simultaneously with the elevating of uprights 38, 40 until frame 72 approaches the sheaves 97, 98. Of course, various stops (not shown) can be provided between uprights 14, 38 and 16, 40 to limit the extended position of uprights 38, 40. The mast 10 is designed such that after "free lift," the cylinders 120 and 141 operate at a 4:1 ratio with the carriage 70 and 2:1 ratio with the uprights 38, 40; thus, these cylinders can be relatively short. Also, as may be seen from FIG. 2, the chain anchors 138, 156 will not interfere or make contact with upper stationary cross-brace 118 as they are elevated since they are not in line with the brace 118.

To lower the uprights 38, 40 and simultaneously carriage 70, hydraulic fluid can be withdrawn from cylinders 120, 141 to retract the rods 124,144. This will enable cross-member 140 to be lowered by gravity and carry with it the uprights 38,40 and cross-brace 61. Then, with uprights 38, 40 fully lowered, hydraulic fluid can be withdrawn from cylinder 90 to raise rod 92 by enabling the weight of carriage 70 to effect its further movement downward.

As is apparent in the foregoing, rod 92 on the one hand, and rods 124, 144 on the other hand, can, but not necessarily, be independently operated. If only rod 92 is operated, then only carriage 70 will be raised or lowered. If rods 124, 144 are moved, then carriage 70 and uprights 38 and 40 will be raised or lowered simultaneously with the raising or lowering of rods 124, 144.

Rod 162 also can be moved independently of rods 92, 124 and 144. By introducing hydraulic fluid into cylinder 160, rod 162 can be extended to apply a force on cross-brace 114 and rotate or tilt the mast 10 in a counterclockwise direction from the position shown in FIG. 1 to lower the forward ends of forks 74, 76. By withdrawing hydraulic fluid from cylinder 160, rod 162 can be retracted to bring carriage 70 and mast 10 into the position shown in FIG. 1.

It will be appreciated that at no time does the cylinder 90 and rod 92 assembly substantially interfere with the driver's line of vision while operating truck 12. As can be seen by considering FIGS. 1 and 3, with rod 92 fully extended, this assembly is only about a third of the way up from the bottom of uprights 14, 16 and substantially below the eye level of the driver when he sits in the driver's seat. Furthermore, cylinders 120, 141 are positioned directly behind uprights 14, 38 and 16, 40 so that the driver's field of vision is not substantially impaired by these two cylinders and their rods.

Also, with cross-brace 114 used as an anchor for cylinders 120, 141, the latter are relatively short in relation to the uprights 14, 16 and extend only about $\frac{2}{3}$ the distance of these uprights. Consequently these cylinders and hence the mast 10 can be placed closer to the frame of the vehicle 12 than if they extended the full distance of the uprights. If cylinders 120, 141 extended the full length of mast 10, their lower one-third portion might interfere with the lower part of the frame of vehicle 12; therefore these cylinders and the mast would have to extend further out from the frame to avoid this interference, thereby causing an unwanted greater load moment.

While the invention has been particularly shown and described with reference to a preferred embodiment thereof, it will be understood by those skilled in the art that the foregoing and other changes in form and details may be made therein without departing from the spirit and scope of the invention.

The embodiments of the invention in which an exclusive privilege or property is claimed are defined as follows:

1. A load-lifting apparatus for a truck or the like, comprising:
   (a) a first pair of fixed, elongated, spaced-apart uprights;
   (b) a second pair of movable, elongated, spaced-apart uprights nested within said first pair of uprights;
   (c) a carriage means for carrying a load, including means enabling movement of said carriage means in relation to said second pair;
   (d) first means, extending between said second pair of uprights, for free-lifting said carriage means in relation to said second pair including
      (i) short hydraulic cylinder means nearer the lower end of said first pair in a fully extended position, including a first cylinder and first rod movable in relation to said first cylinder,
      (ii) a first cross-member connecting the upper ends of said second pair,
      (iii) first and second sheaves rotatably connected to said first cross-member, and
      (iv) first and second chains each connected at one end to said carriage means and at the other end to said first rod, said first and second chains extending over said first and second sheaves, respectively, and said first rod being movable upwardly to lower said carriage means and downwardly to raise said carriage means;
   (e) means, connected to said uprights of said first pair, for bracing said first pair intermediate the ends of said first pair, including two support means behind said uprights of said first pair, respectively, and
   (f) second means for moving said second pair relative to said first pair, including a pair of hydraulic cylinder means, each anchored to one of said support means, for raising and lowering said second pair, respectively.

2. A load-lifting apparatus according to claim 1 wherein said pair of hydraulic cylinder means comprises:
   (a) second and third cylinders connected to their lower ends to said support means, respectively;
   (b) second and third cylinder rods movable in relation to said second and third cylinders, respectively;
   (c) third and fourth sheaves connected to said second and third rods, respectively, and
   (d) third and fourth chains fixed at their one ends near the upper ends of said second and third cylinders, respectively, and at their other ends near the lower ends of said second pair of uprights, respectively, said third and fourth chains extending over said third and fourth sheaves, respectively, whereby when said second and third rods are raised or lowered said second pair is raised or lowered.

3. A load-lifting apparatus according to claim 2 wherein said third and fourth sheaves are at angles to the longitudinal axes of said first pair and said second pair.

4. A load-lifting apparatus according to claim 2 wherein said second and third cylinders, said second and third rods, and said third and fourth sheaves are directly behind said first pair and said second pair of uprights, respectively.

5. A load-lifting apparatus according to claim 1 wherein said bracing means include a second cross member for maintaining said uprights of said first pair in a spaced-apart relationship.

6. A load-lifting apparatus according to claim 1 further comprising:

(a) means for pivotally connecting said first pair and said second pair to the truck near the lower ends of said first pair; and (b) fourth hydraulic cylinder means including a fourth cylinder rod, connected to said bracing means, for tilting said first pair and said second pair.

7. A load-lifting assembly, comprising:

(a) a first pair of spaced-apart uprights;

(b) a second pair of spaced-apart uprights being movable in relation to said first pair of uprights;

(c) a load carrying carriage;

(d) means for moving said carriage in relation to and without movement of said second pair of uprights, including (i) a cross-member fixedly connected to each of said uprights of said second pair, (ii) a first sheave connected to said cross-member, and (iii) means for lifting said carriage and being movable about said first sheave, and (e) means for moving said second pair of uprights relative to said first pair of uprights, including (i) first and second cylinder means for controlling movement of said second pair of uprights, respectively, (ii) second and third sheaves connected, respectively, to said first and second cylinder means; and (iii) first and second chains connected, respectively, to said first and second cylinder means and to said uprights of said second pair, said first and second chains extending about said second and third sheaves.

8. A load-lifting assembly according to claim 7 wherein said first and second cylinder means include, respectively, first and second movable cylinder rods, and wherein said second and third sheaves are connected, respectively, to said first and second cylinder rods.

9. A load-lifting assembly according to claim 7 wherein said means for lifting includes:

(a) third cylinder means for controlling lifting of said carriage; and (b) a third chain connected to said third cylinder means and said carriage and extending about said first sheave.

10. A load-lifting assembly according to claim 9 wherein said third cylinder means includes:

(a) a cylinder; and (b) a movable cylinder rod connected to said third chain and being extendible from said cylinder to lower said carriage and being withdrawable into said cylinder to raise said carriage.

11. A load-lifting assembly according to claim 9 further including a fourth sheave connected to said cross-member, and a fourth chain connected to said cylinder means and said carriage and extending about said fourth sheave.

12. A load-lifting assembly according to claim 11 wherein said third cylinder means includes means for equalizing the load on said first chain and said fourth chain.

13. A load-lifting assembly according to claim 7 wherein one upright of said first pair and one upright of said second pair are coupled together forming one pair of uprights and another upright of said first pair and another upright of said second pair are coupled together forming another pair of uprights, and wherein said first cylinder means and said second cylinder means are coupled, respectively, directly behind said one pair of uprights and said another pair of uprights.

14. A load-lifting assembly according to claim 7 further including means for tilting said first pair of uprights and said second pair of uprights.

* * * * *